US006604849B2

(12) United States Patent
Lin et al.

(10) Patent No.: US 6,604,849 B2
(45) Date of Patent: Aug. 12, 2003

(54) SLURRY DILUTION SYSTEM WITH AN ULTRASONIC VIBRATOR CAPABLE OF IN-SITU ADJUSTMENT OF SLURRY CONCENTRATION

(75) Inventors: Bih-Tiao Lin, Ping-Tung Hsien (TW); Meng-Feng Tsai, Hsinchu (TW); Rong Jye Jang, Kao-Hsiung Hsien (TW); Kung-Teng Huang, Taichung Hsien (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 0 days.

(21) Appl. No.: 09/854,114

(22) Filed: May 11, 2001

(65) Prior Publication Data

US 2002/0048214 A1 Apr. 25, 2002

Related U.S. Application Data

(63) Continuation-in-part of application No. 09/494,178, filed on Jan. 31, 2000, now abandoned.

(30) Foreign Application Priority Data

Dec. 3, 1999 (TW) ..... 88121168 A

(51) Int. Cl.[7] ..... B01F 11/02; B01F 15/02

(52) U.S. Cl. ..... 366/154.2; 366/160.1

(58) Field of Search ..... 366/51, 108, 114, 366/127, 134, 154.2, 160.1, 160.2, 162.1, 181.5, 182.1; 137/828, 896

(56) References Cited

U.S. PATENT DOCUMENTS

| | | | | |
|---|---|---|---|---|
| 2,578,505 | A | * 12/1951 | Carlin | |
| 3,946,994 | A | * 3/1976 | Mertz et al. | |
| 4,106,111 | A | * 8/1978 | Rose | 366/114 |
| 4,168,295 | A | * 9/1979 | Sawyer | 366/114 |
| 4,302,112 | A | * 11/1981 | Steenstrup | 366/114 |
| 4,433,916 | A | * 2/1984 | Hall | 366/114 |
| 4,964,732 | A | * 10/1990 | Cadeo et al. | |
| 5,395,592 | A | * 3/1995 | Bolleman et al. | 366/127 |
| 5,538,628 | A | * 7/1996 | Logan | 366/114 |
| 5,660,465 | A | * 8/1997 | Mason | 366/51 |
| 5,750,440 | A | * 5/1998 | Vanell et al. | |
| 5,803,599 | A | * 9/1998 | Ferri, Jr. et al. | 366/134 |
| 6,007,235 | A | * 12/1999 | Freud et al. | 366/160.2 |
| 6,106,374 | A | * 8/2000 | Boggs et al. | 366/127 |

FOREIGN PATENT DOCUMENTS

| | | | |
|---|---|---|---|
| SU | 1135668 | * | 1/1985 |
| SU | 1153113 | * | 4/1985 |

* cited by examiner

*Primary Examiner*—Charles E. Cooley
(74) *Attorney, Agent, or Firm*—J. C. Patents

(57) ABSTRACT

A slurry dilution system with an ultrasonic vibrator capable of diluting slurry in-situ to any desired level of concentration is proposed. Raw slurry and the de-ionized water fed into the slurry dilution system is mixed and homogenized by an ultrasonic vibrator and a mixer. The well-mixed slurry solution is then delivered to a chemical-mechanical polishing station. When the chemical-mechanical station requires slurry of a different concentration, the raw slurry can be diluted to the desired level simply by changing the rate of flow of de-ionized water into the dilution system.

15 Claims, 6 Drawing Sheets

SLURRY DILUTION SYSTEM WITH AN ULTRASONIC VIBRATOR CAPABLE OF IN-SITU ADJUSTMENT OF SLURRY CONCENTRATION

CROSS-REFERENCE TO RELATED APPLICATION

This application claims the priority benefit of Taiwan application serial no. 88121168, filed Dec. 3, 1999 and is a continuation-in-part of prior application. Ser. No. 09/494,178, filed Jan. 31, 2000, now abandoned, the full disclosure of which is incorporated herein by reference.

BACKGROUND OF THE INVENTION

1. Field of Invention

The present invention relates to a slurry dilution system with an ultrasonic vibrator capable of in-situ adjustment of the slurry concentration. More particularly, the present invention relates to a slurry dilutions system capable of in-situ adjustment of the concentration of slurry supplied to a chemical-mechanical polishing (CMP) station.

2. Description of Related Art

To match the increasing demand for a higher operating speed of electronic devices, semiconductor manufacturers have developed the deep sub-micron technologies. Due to the reduction of device dimensions, depth of focus in photolithographic equipment decreases while the number of layers of multi-level metal (MLM) interconnects increases. Hence, how to maintain planarity in the manufacturing of silicon chip has become an important issue.

Before the deep sub-micron era of semiconductor manufacturing, spin-on-glass (SOG) used to be the main planarization method. However, the method can only planarize local silicon chip area so that global planarization of the entire wafer chip is still unattainable. Without global planarization, the developed pattern in a photoresist layer is likely to be inferior because of intrinsic limitations of the light exposure station in photolithographic operation. In addition, errors in end-oint detection during etching may occur, resulting in a low yield of silicon chips.

Global planarization of silicon chips is now routinely achieved by chemical-mechanical polishing (CMP). During CMP, slurry is one of the components indispensable for successful polishing. Polishing action is achieved through direct contact of slurry with the surface of a silicon chip. Consequently, slurry supply rate, slurry temperature, pH value of the slurry and the distribution of slurry are all critical factors that affect the quality of a polished surface. In some advanced chemical-polishing machines, the concentration of slurry may have to change according to a predefined pattern, as well.

FIG. 1 is a schematic diagram showing the conventional slurry dilution system of a chemical-mechanical polishing station.

As shown in FIG. 1, raw slurry is passed into a pipeline 102*a* through a slurry inlet 100*a,* while de-ionized water for diluting the slurry is passed into a second pipeline 102*b* through a de-ionized water inlet 100*b*. The raw slurry in the pipeline 102*a* and the de-ionized water in the pipeline 102*b* have to pass through flow meters 104*a* and 104*b,* respectively. Hence, the ratio between the incoming raw slurry and the incoming de-ionized water can be monitored and determined according to demand.

Thereafter, the raw slurry and the de-ionized water are passed into a mixer 106 of 10~100 liters where the two are churned to form diluted slurry having a uniform concentration. The diluted slurry is transferred to a slurry supply tank 108. From the slurry supply tank 108, the diluted slurry can be delivered to a chemical-mechanical polishing station 112 through a supply pipe 110.

However, the average slurry supply tank for storing diluted slurry has a capacity of 100~10,000 liters in order to keep the concentration of the diluted slurry at a constant. Such a tank occupies a lot of floor space. Moreover, if the concentration of the slurry has to be varied, all of the slurry originally in the supply tank must be removed completely for the new batch of slurry with different concentration. Therefore, it's not easy to adjust the concentration of the slurry, and too much slurry is wasted during the changeover of the slurry. In addition, a chemical-mechanical polishing operation that demands diluted slurry of different concentrations in sequence must either use a few independent dilution systems, or else the polishing has to be conducted in a number of different chemical-mechanical polishing stations.

SUMMARY OF THE INVENTION

The present invention provides a slurry dilution system capable of diluting slurry in-situ to a defined level of concentration. The slurry dilution system occupies very little clean room space but can provide diluted slurry of any concentration to a chemical-mechanical polishing station on demand.

To achieve these and other advantages and in accordance with the purpose of the invention, as embodied and broadly described herein, the invention provides a slurry dilution system. The slurry dilution system includes a first pipeline having a first terminal for the entrance of raw slurry into the system, a second pipeline having a first terminal for the entrance of slurry diluting de-ionized water into the system, a first flow meter installed somewhere along the first pipeline for measuring the rate of flow of raw slurry, a second flow meter installed somewhere along the second pipeline for measuring the flow of de-ionized water, a delivery pipeline having a first terminal connected to the second terminal of both the first pipeline and the second pipeline and the second terminal of the delivery pipeline coupled to a chemical-mechanical polishing station, an ultrasonic vibrator installed near the first terminal of the delivery pipeline for mixing the raw slurry and the de-ionized water and preventing slurry particles from sticking to the pipe walls and forming clumps so that a higher mixing efficiency is obtained, and a mixer installed near the second terminal of the delivery pipeline for preventing the deposition of slurry particles, wherein the delivery pipeline includes at least one turning region between the ultrasonic vibrator and the mixer.

In this invention, raw slurry and de-ionized water fed into the slurry dilution system are mixed and homogenized by the ultrasonic or megasonic vibrator and the small mixer. The well-mixed slurry solution is then delivered to a chemical-mechanical polishing station. When the chemical-mechanical station requires slurry of a different concentration, raw slurry can be diluted to the desired level simply by changing the rate of flow of de-ionized water into the dilution system.

Since there is no need for a special supply tank to accommodate the diluted slurry, the area occupied by the slurry dilution system is smaller. Hence, production cost of the system is also reduced.

The slurry dilution system of this invention can be built inside any chemical-mechanical polishing station. Hence, uniformly slurry diluted to any level can be supplied to the chemical-mechanical polishing station without passing through lengthy pipelines.

By varying the rate of flow of de-ionized water with respect to slurry, the desired degree of dilution can be obtained. Consequently, the dilution system is capable of providing the slurry in any types of chemical-mechanical polishing operations.

The vibration provided by the Ultrasonic vibrator in this invention is capable of increasing the mixing efficiency of the diluted slurry, thereby improving the homogeneity of slurry solution. In addition, if a U-shaped slurry delivery pipeline is used, mixing efficiency can be further increased.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
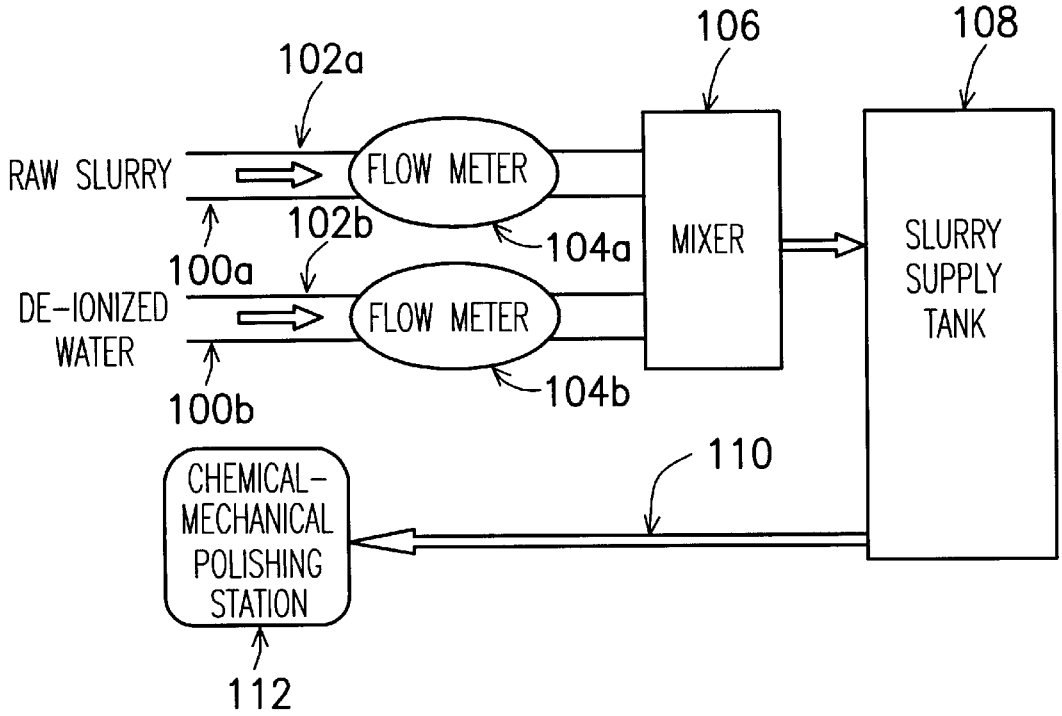
FIG. 1 (PRIOR ART)
FIG. 1 is a schematic diagram showing the conventional slurry dilution system of a chemical-mechanical polishing station.

Reference will now be made in detail to the present preferred embodiments of the invention, examples of which are illustrated in the accompanying drawings. Wherever possible, the same reference numbers are used in the drawings and the description to refer to the same or like parts.

Figure 2:
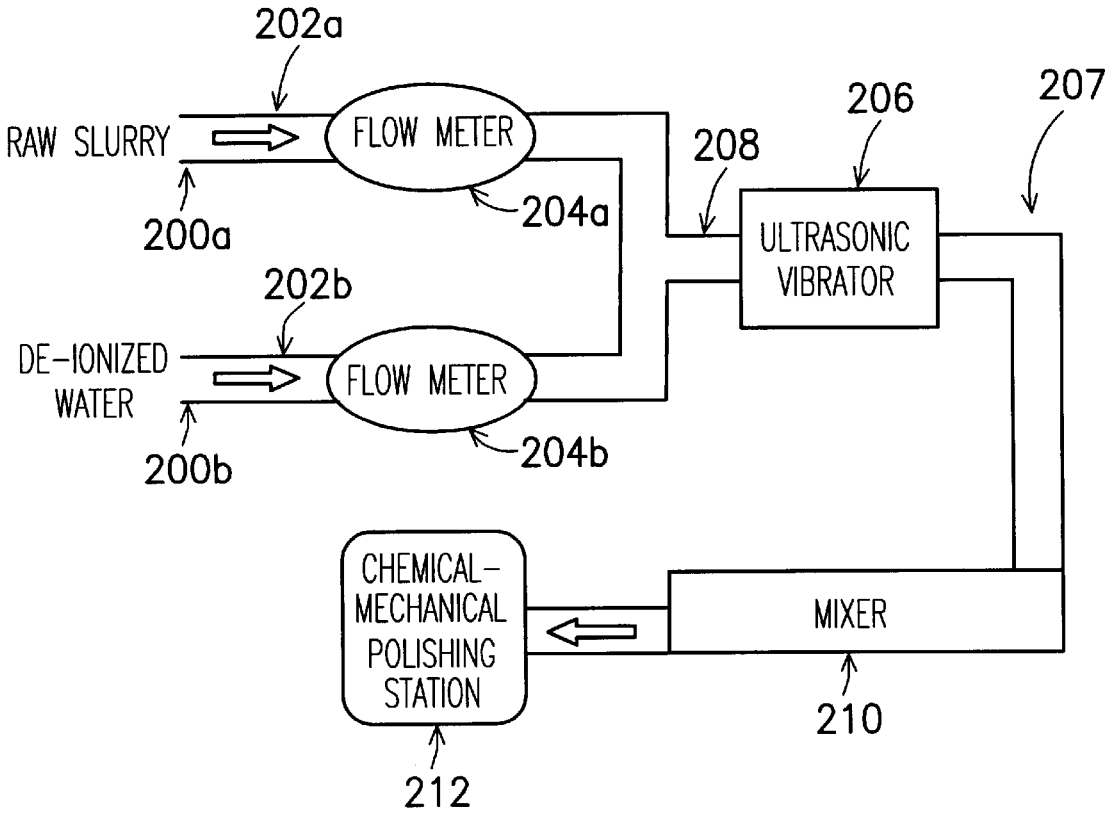
FIG. 2 is a schematic diagram showing a slurry dilution system of a chemical-mechanical polishing station according to one preferred embodiment of this invention.

FIG. 2 is a schematic diagram showing a slurry dilution system of a chemical-mechanical polishing station according to one preferred embodiment of this invention.

As shown in FIG. 2, raw slurry is passed into a pipeline 202*a* through a slurry inlet 200*a*, while de-ionized water for diluting the slurry is passed into a second pipeline 202*b* through a de-ionized water inlet 200*b*. The raw slurry in the pipeline 202*a* and the de-ionized water in the pipeline 202*b* have to pass through flow meters 204*a* and 204*b*, respectively. Hence, the ratio between the incoming raw slurry and the incoming de-ionized water can be monitored and determined according to demand.

The raw slurry, after passing through the first flow meter 204*a*, and the de-ionized water, after passing through the second flow meter 204*b*, are merged together at the entrance to another pipeline 208. The pipeline 208 has a turning region 207 in its middle portion, and is connected to an ultrasonic vibrator 206 between the entrance and the turning region 207. The ultrasonic vibrator 206 installed somewhere along the pipeline 208 is capable of preventing the attachment of slurry particles to pipe walls. If too many of these slurry particles are attached to the pipe walls, concentration of slurry supplied to a chemical-mechanical polishing station is likely to be affected. Ultimately, reliability of the polishing process will deteriorate. In addition, the ultrasonic vibrator 206 can reduce cluster formation within the slurry so that mixing efficiency is increased.

The delivery pipeline 208 can be fabricated in a U-shape for further increasing the mixing efficiency of slurry.

After passing through the ultrasonic vibrator 206, the slurry and de-ionized water mixture flows along the delivery pipeline 208 to reach a small mixer 210 having a volume of 0.8~10 liter, while the length of the portion of the delivery pipeline 208 between the ultrasonic vibrator 206 and the mixer 210 ranges from 20 centimeter to 200 centimeter. All along the pipeline 208, de-ionized water and the slurry are mixed and churned so that a homogenized slurry solution diluted to the desired concentration can be delivered to a polishing station.

Figure 5:
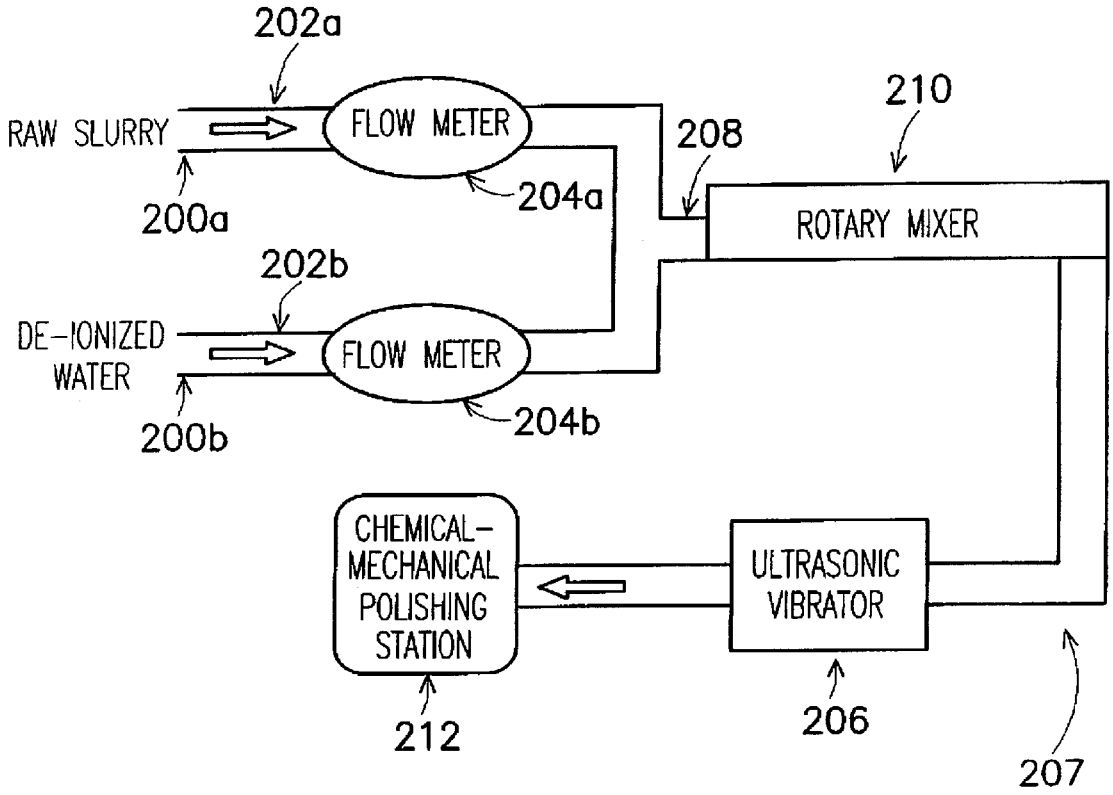
FIG. 5 is a schematic diagram showing a slurry dilution system of a chemical-mechanical polishing station similar to FIG. 3 with the rotary mixer.
Figure 6:
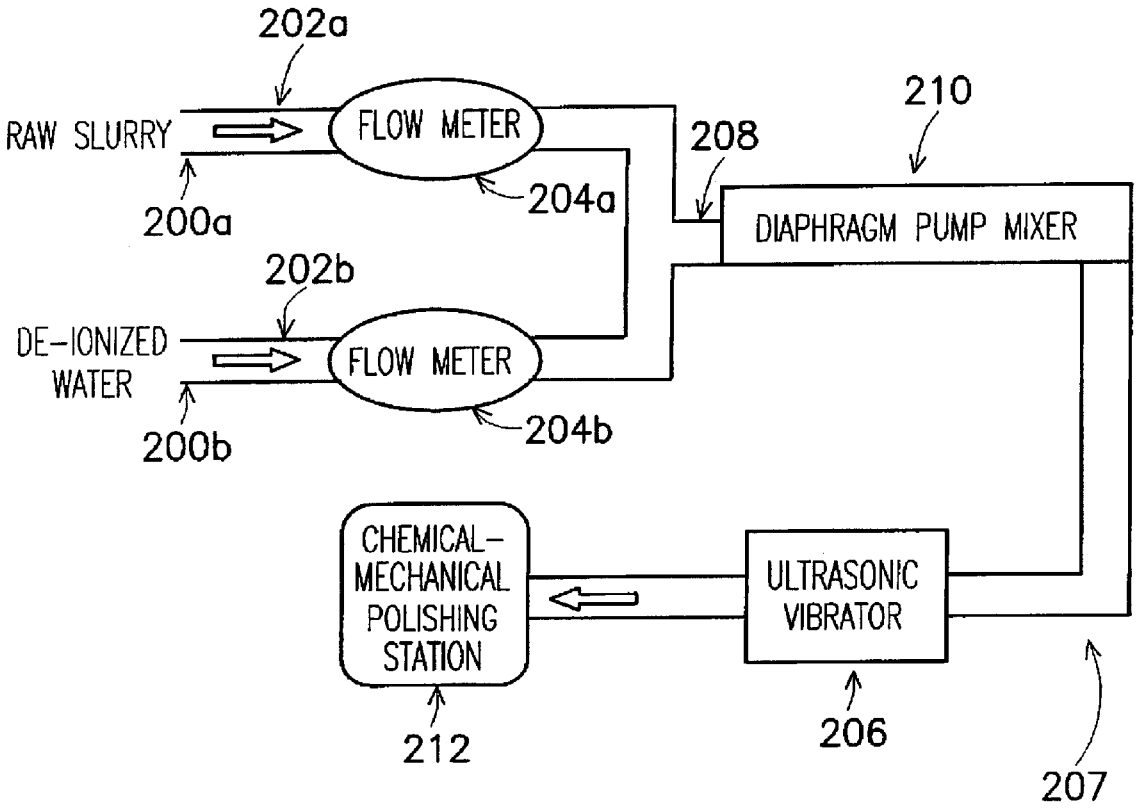
FIG. 6 is a schematic diagram showing a slurry dilution system of a chemical-mechanical polishing station similar to FIG. 3 with the diaphragm pump mixer.
Figure 7:
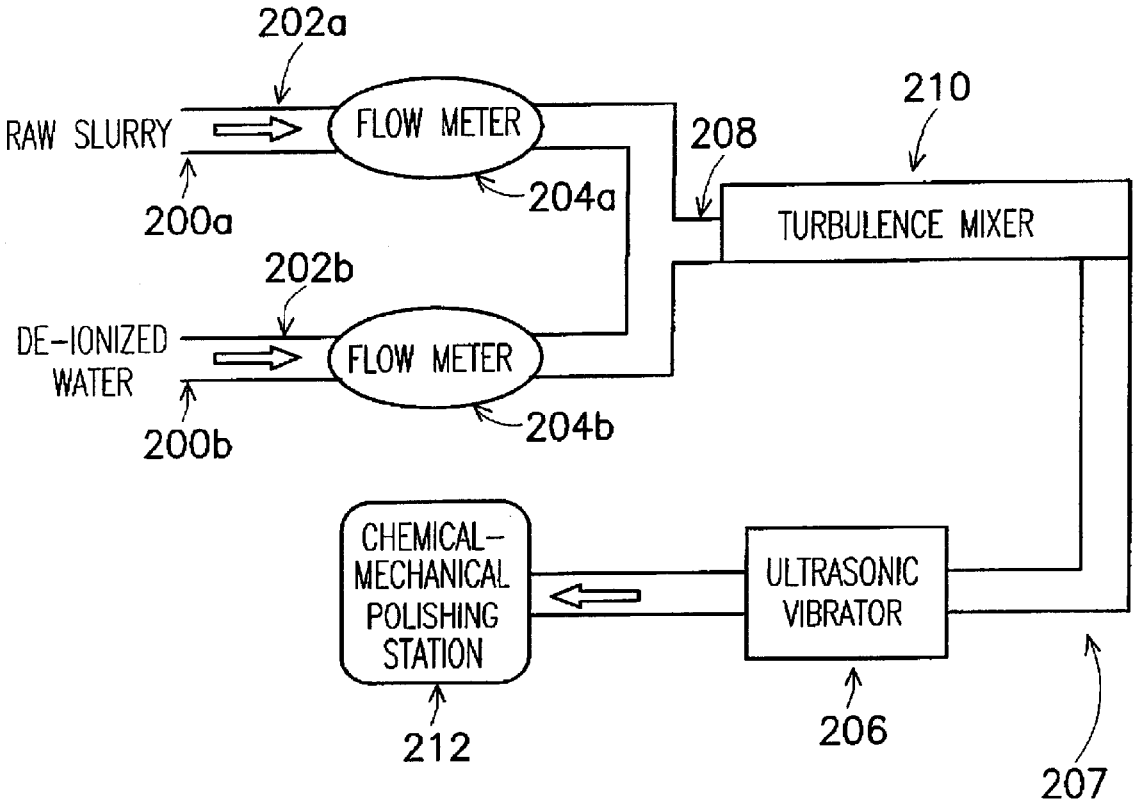
FIG. 7 is a schematic diagram showing a slurry dilution system of a chemical-mechanical polishing station similar to FIG. 3 with turbulence Mixer.

The small mixer 210, for example, can be a mixer including the rotary type, the diaphragm pump type or the turbulence type. The purpose of having a mixer is to keep the slurry solution in constant agitation so that suspended particles are prevented from settling 3 down. FIGS. 5–7 are the alternative applications similar to FIG. 3 but with the specific mixers. In FIG. 5, the mixer 210 is a rotary mixer as an example. In FIG. 6, the mixer 210 is a diaphragm pump mixer as an example. In FIG. 7, the mixer 210 is a turbulence mixer as an example.

From the small mixer 210, the well-mixed slurry solution is passed on to a chemical-mechanical polishing station 212 at the other end of the delivery pipeline 208. Since volume of the mixer 210 is very small, the quantity of well-mixed slurry having a definite concentration at any one time is very small. Thus, when slurry solution of a different concentration is required in a subsequent polishing process, very little slurry is wasted in the changeover. Moreover, the changeover is quick. Slurry diluted to the desired concentration level can be obtained almost immediately by adjusting the flow of de-ionized water.

Figure 4:
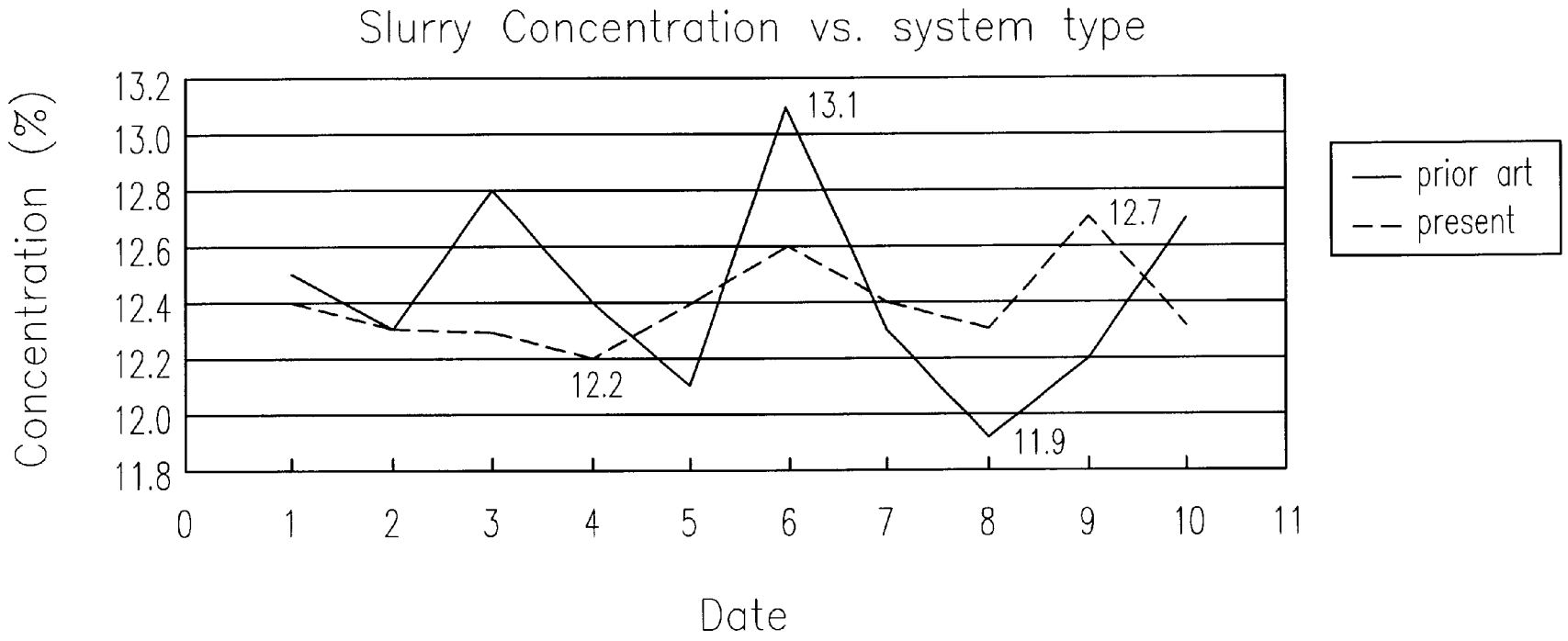
FIG. 4 is a plot showing the variations of the slurry concentrations provided by the present system and by the old system.

In addition, it's found that the range of the variation of the slurry concentration provided by the present system is smaller than that done by the old system in FIG. 1. As shown in FIG. 4, the range of the variation of the slurry concentration provided by the old system is 9.6% ((highest-lowest)/[(highest+lowest)/2]=(13.1−11.9)/[(13.1+11.9)/2]=1.2/12.5=0.096), while that done by the present system is only 4.0% ((12.7−12.2)/[(12.7+12.2)/2]=0.5/12.45=0.040), wherein the volume of the small mixer 210 is 0.8~10 liter, and there is at least one turning region on the delivery pipeline 208 in the present system.

Figure 3:
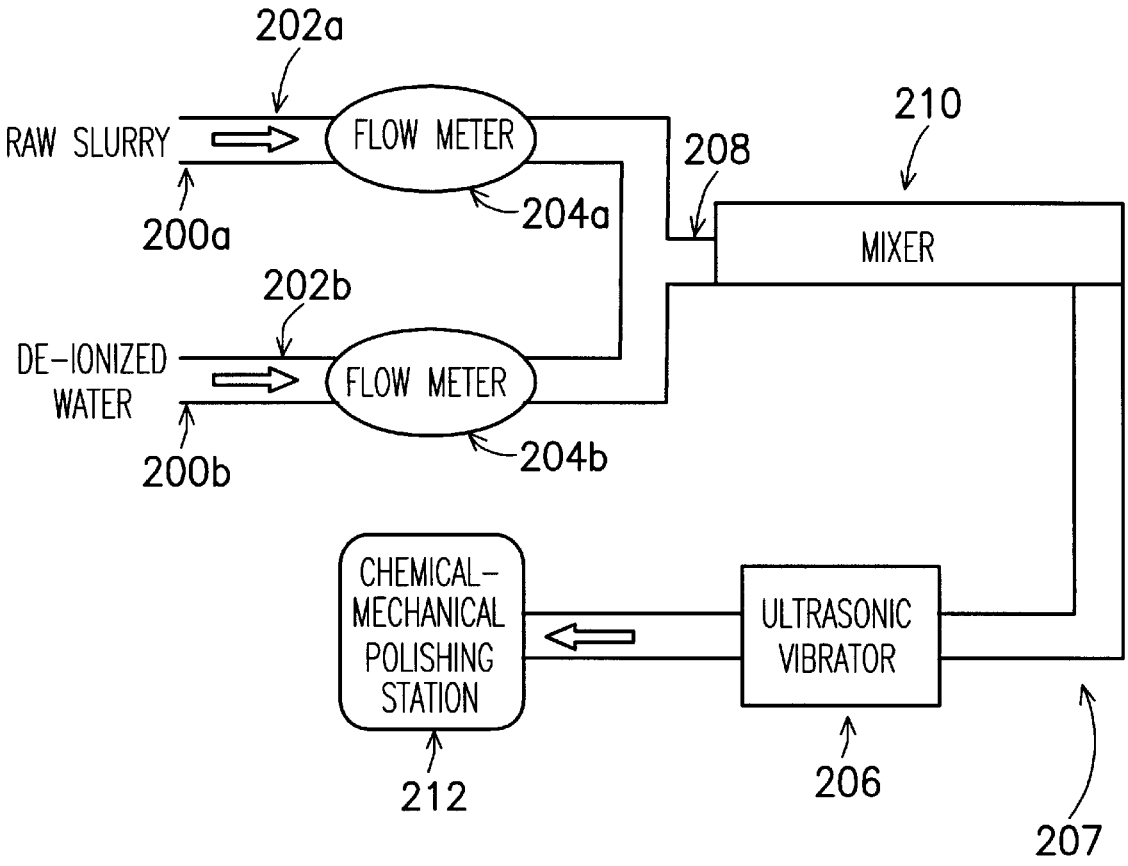
FIG. 3 is a schematic diagram showing a slurry dilution system of a chemical-mechanical polishing station according to another preferred embodiment of this invention.

This invention also permits the mutual interchange of positions between the ultrasonic vibrator 206 and small mixer 210, as shown in FIG. 3. In other words, the raw slurry and the de-ionized water are fed into the mixer 210 to form diluted slurry. The diluted slurry is later shaken by the ultrasonic vibrator 206 just before exiting the slurry delivery pipeline to the chemical-mechanical polishing station 212. In this way, slurry particles are prevented from settling on the pipe walls or clustering inside the slurry.

In summary, raw slurry and de-ionized water are fed into the slurry dilution system and later mixed and homogenized by the ultrasonic vibrator and the small mixer. The well-mixed slurry solution is then delivered to a chemical-mechanical polishing station. When the chemical-mechanical station requires slurry having a different solution concentration, slurry can be diluted to the desired level simply by changing the rate of influx of de-ionized water into the dilution system.

Since there is no need for a special supply tank to accommodate the diluted slurry, the area occupied by the slurry dilution system is smaller. Hence, production cost of the system is also reduced.

The slurry dilution system of this invention can be built inside any chemical-mechanical polishing station. Hence, uniformly slurry diluted to any level can be supplied to the chemical-mechanical polishing station without passing through lengthy pipelines.

By varying the rate of flow of de-ionized water with respect to slurry, the desired degree of dilution can be obtained. Consequently, the dilution system is capable of providing the slurry in various types of chemical-mechanical polishing operations.

The vibration provided by the ultrasonic vibrator in this invention is capable of increasing the mixing efficiency of the diluted slurry, thereby improving the homogeneity of slurry solution. In addition, if a U-shaped slurry delivery pipeline is used, mixing efficiency can be further increased.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A slurry dilution system capable of diluting slurry in-situ to any desired level of concentration, the slurry dilution system comprising:

a first pipeline having an inlet for feeding raw slurry into the slurry dilution system;

a second pipeline having an inlet for feeding de-ionized water into the slurry dilution system;

a first flow meter installed somewhere along the first pipeline for measuring a rate of flow for raw slurry;

a second flow meter installed somewhere along the second pipeline for measuring a rate of flow for de-ionized water;

a delivery pipeline having an inlet, wherein the delivery pipeline inlet is connected to both an outlet of the first pipeline and an outlet of the second pipeline, and a delivery pipeline outlet is connected to a chemical-mechanical polishing station;

an ultrasonic vibrator installed near a first terminal of the delivery pipeline for mixing and homogenizing the raw slurry and the de-ionized water and preventing slurry particles from sticking on pipe walls and from clustering so that mixing efficiency is improved; and a mixer installed near a second terminal of the delivery pipeline for preventing the slurry particles from settling, wherein the delivery pipeline includes at least one turning region between the ultrasonic vibrator and the mixer, and a U-shape region at the first terminal directly connecting with the outlet of the first pipeline and the outlet of the second pipeline.

2. The system of claim 1, wherein the ultrasonic vibrator is installed next to the inlet of the delivery pipeline while the mixer is installed between the ultrasonic vibrator and the delivery pipeline outlet.

3. The system of claim 1, wherein the mixer is installed next to the inlet of the delivery pipeline while the ultrasonic vibrator is installed between the mixer and the delivery pipeline outlet.

4. The system of claim 1, wherein the mixer is rotary-type mixer.

5. The system of claim 1, wherein the mixer is a diaphragm pump-type mixer.

6. The system of claim 1, wherein the mixer is a turbulent-type mixer.

7. The system of claim 1, wherein a volume of the mixer ranges from 0.8 liter to 10 liter.

8. The system of claim 1, wherein a length of a portion of the delivery pipeline between the ultrasonic vibrator and the mixer ranges from 20 centimeter to 200 centimeter.

9. A slurry dilution system capable of in-situ dilution of slurry to any desired level of concentration, the slurry dilution system comprising:

a first pipeline having an inlet for feeding raw slurry into the slurry dilution system;

a second pipeline having an inlet for feeding de-ionized water into the slurry dilution system;

a first flow meter installed somewhere along the first pipeline for measuring a rate of flow for raw slurry;

a second flow meter installed somewhere along the second pipeline for measuring a rate of flow for de-ionized water;

a U-shaped delivery pipeline having an inlet, wherein the inlet is connected to both an outlet of the first pipeline and an outlet of the second pipeline, and a delivery pipeline outlet connected to a chemical-mechanical polishing station;

an ultrasonic vibrator installed next to the inlet of the U-shaped delivery pipeline for mixing and homogenizing the raw slurry and the de-ionized water and for preventing slurry particles from sticking on pipe walls and from clustering so that mixing efficiency is improved; and a mixer installed between the ultrasonic vibrator and the delivery pipeline outlet for preventing the slurry particles from settling.

10. The system of claim 9, wherein the mixer is a rotary-type mixer.

11. The system of claim 9, wherein the mixer is a diaphragm pump-type mixer.

12. The system of claim 9, wherein the mixer is a turbulent-type mixer.

13. The system of claim 9, wherein a volume of the mixer ranges from 0.8 liter to 10 liter.

14. The system of claim 9, wherein a length of a portion of the delivery pipeline between the ultrasonic vibrator and the mixer ranges from 20 centimeter to 200 centimeter.

15. A slurry dilution system capable of diluting slurry in-situ to any desired level of concentration, the slurry dilution system comprising:

a first pipeline having an inlet for feeding raw slurry into the slurry dilution system;

a second pipeline having an inlet for feeding de-ionized water into the slurry dilution system;

a first flow meter installed somewhere along the first pipeline for measuring a rate of flow for raw slurry;

a second flow meter installed somewhere along the second pipeline for measuring a rate of flow for de-ionized water;

a delivery pipeline having an inlet, wherein the delivery pipeline inlet is connected to both an outlet of the first pipeline and an outlet of the second pipeline, and a delivery pipeline outlet is connected to a chemical-mechanical polishing station;

an ultrasonic vibrator installed next to the inlet of the delivery pipeline for mixing and homogenizing the raw slurry and the de-ionized water and preventing slurry particles from sticking on pipe walls and from clustering so that mixing efficiency is improved; and a mixer installed between the ultrasonic vibrator and the delivery pipeline outlet for preventing the slurry particles from settling;

wherein the delivery pipeline includes at least one turning region between the ultrasonic vibrator and the mixer.

* * * * *